US010174557B2

(12) United States Patent
Freyer

(10) Patent No.: US 10,174,557 B2
(45) Date of Patent: Jan. 8, 2019

(54) METHOD AND DEVICE FOR MAKING A LATERAL OPENING OUT OF A WELLBORE

(71) Applicant: Fishbones AS, Stavanger (NO)

(72) Inventor: Rune Freyer, Hafrsfjord (NO)

(73) Assignee: Fishbones AS, Stavanger (NO)

( * ) Notice: Subject to any disclaimer, the term of this patent is extended or adjusted under 35 U.S.C. 154(b) by 100 days.

(21) Appl. No.: 14/890,773

(22) PCT Filed: Jun. 17, 2014

(86) PCT No.: PCT/NO2014/050102

§ 371 (c)(1),
(2) Date: Nov. 12, 2015

(87) PCT Pub. No.: WO2014/209126

PCT Pub. Date: Dec. 31, 2014

(65) Prior Publication Data

US 2016/0097239 A1 Apr. 7, 2016

(30) Foreign Application Priority Data

Jun. 24, 2013 (EP) ..... 13173376

(51) Int. Cl.
*E21B 4/02* (2006.01)
*E21B 4/16* (2006.01)
(Continued)

(52) U.S. Cl.
CPC ..... *E21B 7/046* (2013.01); *E21B 3/00* (2013.01); *E21B 4/02* (2013.01); *E21B 4/16* (2013.01);
(Continued)

(58) Field of Classification Search
CPC ... E21B 4/02; E21B 4/16; E21B 7/061; E21B 7/062; E21B 29/06; E21B 41/0035
See application file for complete search history.

(56) References Cited

U.S. PATENT DOCUMENTS 3,797,576 A * 3/1974 Azalbert ..... E21B 4/00 166/169
4,007,797 A * 2/1977 Jeter ..... E21B 4/00 173/149

(Continued)

FOREIGN PATENT DOCUMENTS

EP 2098679 9/2009
WO 2002086278 10/2002

OTHER PUBLICATIONS

International Search Report for PCT/NO2014/050102 dated Aug. 25, 2014.

(Continued)

*Primary Examiner* — Cathleen R Hutchins
(74) *Attorney, Agent, or Firm* — Andrus Intellectual Property Law, LLP

(57) ABSTRACT

A method and device are for making lateral openings out of a wellbore in a ground formation where at least one laterally directed drill string is movable in the axial direction inside a motherbore tubular, and where the leading end portion of the drill string is equipped with the drill bit that is driven by a rotatable drill string. The method includes connecting a fluid driven engine to the rotatable drill string inside the motherbore tubular, and directing flow in the motherbore tubular through the fluid driven engine to create rotation of the drill bit via the drill string.

20 Claims, 3 Drawing Sheets

(51) Int. Cl.

| | |
|---|---|
| ***E21B 7/06*** | (2006.01) |
| ***E21B 29/06*** | (2006.01) |
| ***E21B 7/04*** | (2006.01) |
| ***E21B 23/08*** | (2006.01) |
| ***E21B 41/00*** | (2006.01) |
| ***E21B 43/26*** | (2006.01) |
| ***E21B 3/00*** | (2006.01) |

(52) U.S. Cl.
CPC ..... *E21B 7/062* (2013.01); *E21B 23/08* (2013.01); *E21B 41/0035* (2013.01); *E21B 43/26* (2013.01)

(56) References Cited

U.S. PATENT DOCUMENTS

| | | | | |
|---|---|---|---|---|
| 4,432,423 | A * | 2/1984 | Lyons | E21B 4/02 175/100 |
| 5,853,056 | A | 12/1998 | Landers | |
| 2011/0005834 | A1 | 1/2011 | Crawford | |
| 2011/0017445 | A1* | 1/2011 | Freyer | E21B 7/061 166/222 |

OTHER PUBLICATIONS

Written Opinion for PCT/NO2014/050102 dated Aug. 25, 2014.
Written Opinion for PCT/NO2014/050102 dated Apr. 30, 2015.
International Preliminary Report on Patentability for PCT/NO2014/050102 dated Sep. 17, 2015.

* cited by examiner

I-I

METHOD AND DEVICE FOR MAKING A LATERAL OPENING OUT OF A WELLBORE

CROSS-REFERENCE TO RELATED APPLICATIONS

This application is the U.S. national stage application of International Application PCT/NO2014/050102, filed Jun. 17, 2014, which international application was published on Dec. 31, 2014, as International Publication WO2014/209126 in the English language. The international application is incorporated herein by reference, in entirety. The international application claims priority to European Patent Application No. 13173376.8, filed Jun. 24, 2013, which is incorporated herein by reference, in entirety.

FIELD

There is provided an improved method and device for making a lateral opening out of a wellbore. More precisely, there is provided an improved method for making lateral openings out of a wellbore and into ground formation where at least one laterally directed drill string is movable in the axial direction inside a motherbore tubular, and where the leading end portion of the drill string is equipped with a drill bit that is driven by the rotatable drill string. The invention also includes a device for making a lateral opening out of a wellbore.

A motherbore tubular forms a major conduit through at least a part of the wellbore. Having narrower lateral openings into a ground formation surrounding the wellbore may be of great help for increasing productivity, when conditions in a well have to be accurately determined, and when well maintenance is to be undertaken.

BACKGROUND

It is well known to treat a carbonate ground formation with acid in order to stimulate the well. According to prior art, relatively large quantities of hydrochloric acid have to be pumped into the well. Often the treatment has limited success. If the acid is not flowing into the intended sections of the well, the treatment may even lead to undesired increase in gas and water production.

The lack of desirable effects could be due to a breakdown of the formation matrix or that the acid follows natural fractures in the formation.

Several methods have been proposed for the purpose of improving well productivity. It is thus known to position a deflecting shoe at a lateral opening in the motherbore tubular. A jetting hose attached to coiled tubing is then fed from the surface and deflected through the opening in the motherbore tubular and further on into the formation as the acid dissolves the formation. Although safeguarding that the acid is flowing into the desired part of the formation, the method is producing unnecessary large passages in the formation and the lateral openings are jetted sequentially.

EP 2098679 shows a motherbore tubular having narrow pipes directed towards the ground formation. The narrow pipes are telescopically penetrating the ground formation.

WO 2012105850 proposes to direct a narrow pipe towards the formation. Several narrow pipes that are made to extend into the ground formation may be positioned on or in the motherbore tubular. The narrow pipes may have sensors attached. The document presents a drill bit at the leading end of the narrow pipe. However, apart from a an engine placed close to the drill bit, no method of transferring power to the drill bit is given.

SUMMARY

The purpose of the invention is to overcome or reduce at least one of the disadvantages of the prior art.

The purpose is achieved according to the invention by the features as disclosed in the description below and in the following patent claims.

According to a first aspect of the invention there is provided a method for making lateral openings out of a wellbore in a ground formation where at least one laterally directed drill string is movable in the axial direction inside a motherbore tubular, and where the leading end portion of the drill string is equipped with a drill bit that is driven by the rotatable drill string, wherein the method includes:

connecting to the rotatable drill string inside the motherbore tubular an axially movable fluid driven engine to rotate the drill string inside the motherbore tubular; and directing flow in the motherbore tubular through the fluid driven engine to create rotation of the drill bit via the drill string.

The method may include inserting the drill string through a laterally directed non-rotating pipe that is movable in the axial direction inside the motherbore tubular.

The method may include passing at least the non-rotating pipe or the drill string through a wall opening of the motherbore tubular, preferably at a position distant from the end portion of the motherbore tubular.

The method may include directing a portion of the fluid flow in the motherbore tubular through the fluid driven engine, possibly restricting fluid bypassing the fluid driven engine.

The method may include letting at least the non-rotating pipe or the drill string be submitted to a differential pressure between the motherbore tubular and the annular pressure in the wellbore and thus hydraulically forced towards the ground formation.

According to a second aspect of the invention there is provided a pipe device for making lateral openings out of a wellbore in a ground formation where at least one laterally directed drill string is movable in the axial direction inside a motherbore tubular, and where the leading end portion of the drill string is equipped with a drill bit that is driven by the rotatable drill string, wherein a fluid driven engine axially movable in the motherbore tubular is connected to the rotatable drill string inside the motherbore tubular and designed to be driven by fluid flow in the motherbore tubular.

The drill string may be enclosed by a non-rotating pipe. The at least non-rotating pipe or drill string passes through a wall opening of the motherbore tubular, preferably at a position distant from the end portion of the motherbore tubular.

At least the non-rotating pipe or the drill string may be subjected to a differential pressure between the motherbore tubular and the annular pressure in the wellbore and thus hydraulically forced towards the ground formation.

At least the non-rotating pipe or the drill string may be subjected to a differential pressure across the fluid driven engine in the motherbore tubular and thus hydraulically forced towards the ground formation.

The fluid driven engine may be movable along guides in the motherbore tubular. A bypass opening may be present. The flow resistance through a choke in the form of an annulus is thus kept constant as the fluid driven engine is moved along the motherbore tubular.

The bypass opening may have a choke that may be adjusted to give a desired pressure drop across the fluid driven engines. A simple way of achieving this is to choose a suitable length of a fluid driven engine housing combined with the actual cross section of the annulus. Valve systems may also be applicable to give the desired pressure drop in the fluid bypassing each fluid driven engine.

The non-rotating pipe may be connected to a housing of the fluid driven engine. The non-rotating pipe is thus restricted from rotating if the housing is restricted from rotation, for instance by the guides inside the motherbore tubular.

A non-rotating pipe or a drill string that is connected to another fluid driven engine may be passing the fluid driven engine inside the motherbore tubular.

The fluid in the motherbore tubular may be passing through more than one fluid driven engine.

The fluid driven engine may be a turbine, vane engine, piston engine, progressive cavity engine or an Archimedes engine.

The method and device according to the invention give a simple and safe solution to the task of providing torque to a drill bit of a non-rotating pipe that extends from the motherbore tubular. The method and device is particularly well suited for cases where more than one non-rotating pipe is to penetrate the ground formation.

BRIEF DESCRIPTION OF THE DRAWINGS

Below, an example of a preferred method and device are explained under reference to the enclosed drawings, where.

DETAILED DESCRIPTION OF THE DRAWINGS

On the drawings the reference number 1 denotes a wellbore in a ground formation 2. A motherbore tubular 4 is positioned in the wellbore 1.

Figure 1:
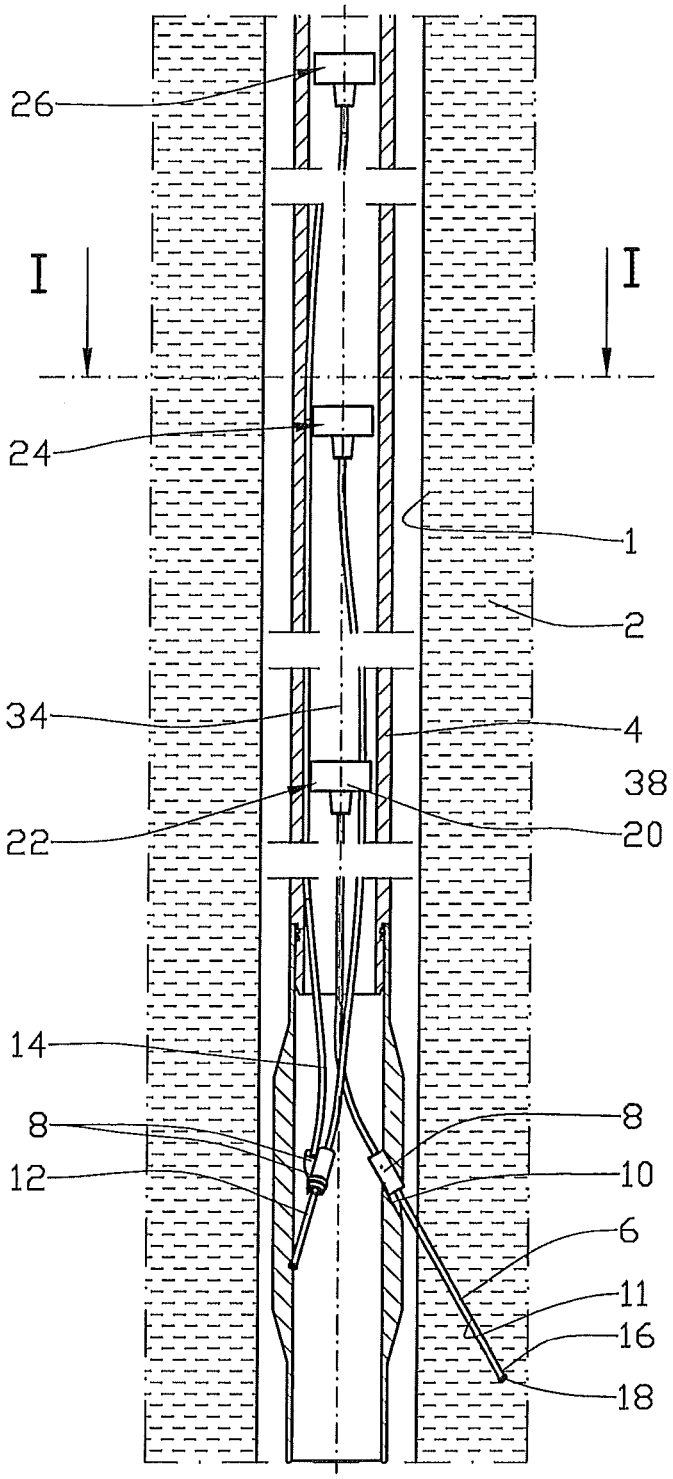
FIG. 1 shows a section of a wellbore with a motherbore tubular inside, the motherbore tubular having non rotating pipe for making lateral openings in a ground formation, and where a fluid driven engine according to the invention is positioned inside the tubular.
Figure 2:
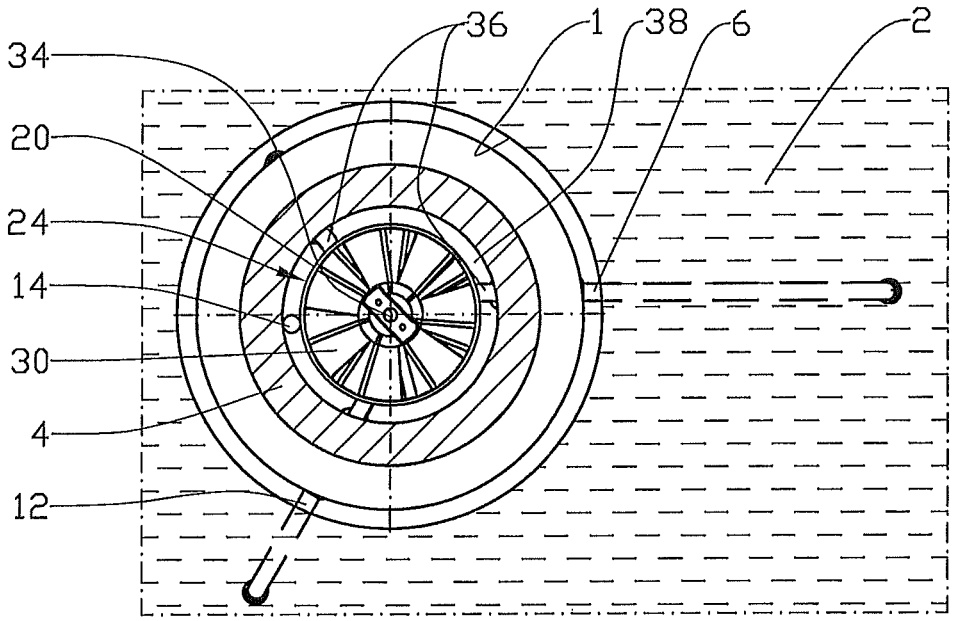
FIG. 2 shows a section I-I in FIG. 1 to a larger scale.

A first non-rotating pipe 6 is passing through a collar 8 in an opening 10 in the motherbore tubular 4 and into a lateral opening 11 in the ground formation 2. A second non-rotating pipe 12 and a third non-rotating pipe 14 that are passing through respective collars 8 are shown in FIG. 1 where only the ground formation 2 and the motherbore tubular 4 are sectioned.

Below, the first, second and third non-rotating pipes 6, 12, 14 are termed "non-rotating pipes" when the description applies to all of them.

At their leading end portion 16 the non-rotating pipes 6, 12, 14 are equipped with a drill bit 18 while the non-rotating pipes 6, 12, 14 at their opposite end portion are connected to a housing 20 of a first, a second and a third fluid driven engine 22, 24, 26 respectively. A drill string 28 as shown in FIG. 4, which extends through the first non-rotating pipe 6 connecting the drill bit 18 at the leading end portion 16, to a rotor 30 of the first fluid driven engine 22.

Figure 4:
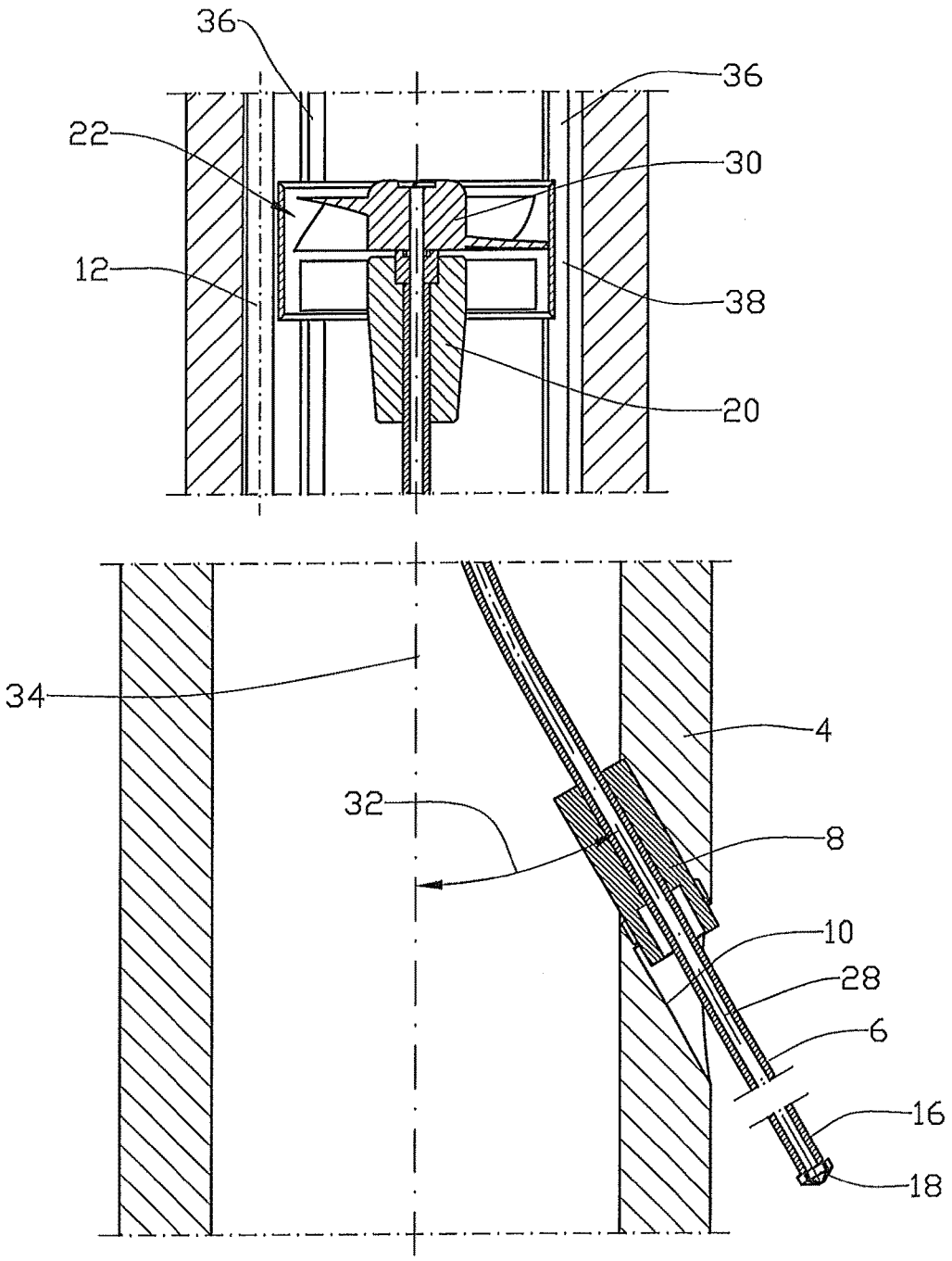
FIG. 4 shows items from FIG. 1 in a larger scale.

As shown in a larger scale in FIG. 4, the collar 8 has an angle 32 relative a centre line 34 of the motherbore tubular 4. The collar 8 thus directs the first non-rotating pipe 6 into the ground formation 2. The angle 32 may be fixed or adjustable.

Figure 3:
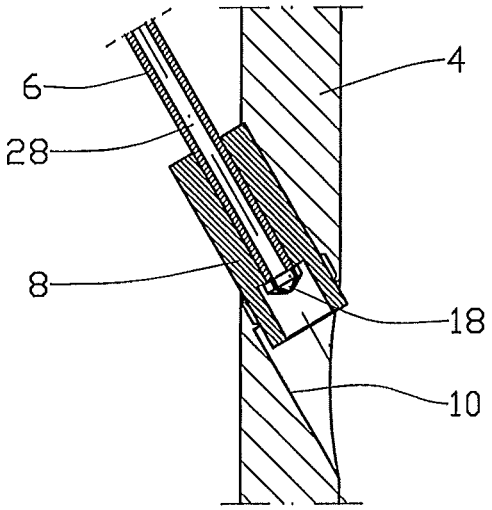
FIG. 3 shows to an even larger scale a drill bit and a non rotating pipe in their initial position.

In its retracted initial position, the drill bit 18 is positioned inside the collar 8 as shown in FIG. 3.

Optionally, guides 36 may be placed in an annulus 38 between the fluid driven engines 22, 24, 26 and the motherbore tubular 4. Guides 36 will maintain the housings 20 of the fluid driven engines 22, 24, 26 in a centre position in the motherbore tubular 4 when moved along.

As may bee seen from the figures, the second and third non-rotating pipes 12, 14 are passing through the annulus 38 surrounding the first fluid driven engine 22. This feature allows for several fluid driven engines 22, 24, 26 to be positioned at different positions along the motherbore tubular 4.

The flow resistance through each annulus 38, which may form a choke relative each fluid driven engine 22, 24, 26, may be adjusted to give a desired pressure drop across the fluid driven engines 22, 24, 26. A simple way of achieving this is to choose a suitable length of the housing 20 combined with the actual cross section of the annulus 38. Valve systems, not shown, may also be applicable.

In this preferred embodiment, the fluid driven engines 22, 24, 26 are in the form of turbine engines. In other embodiments, not shown, any useful fluid driven engine may be utilized, such as vane engines, piston engines, progressive cavity engines or Archimedes engines.

When fluid is flowing through the motherbore tubular 4, at least a portion of the fluid is flowing through the fluid driven engines 20, 22, 24. The rotor 30 of the first fluid driven engine 20 starts rotating and transmits the rotation to the drill bit 18 via the rotating drill string 26 inside the first non-rotating pipe 6. The drill bit is initially positioned in its collar 8, see FIG. 3.

The combined hydraulic force created by differential pressure across the first fluid driven engine 20 and the pressure difference between the inside and the outside of the motherbore tubular 4 forces the first non-rotating pipe 6 out of the motherbore tubular 4 and into the ground formation 2 as indicated in FIG. 1.

As the cross section of the drill bit 18 is tiny compared to the cross section of the motherbore tubular 4, the rotor 30 may have a relatively large diameter. Necessary pressure drop across the fluid driven engines 20, 22, 24 is limited. Substantially more than three fluid driven engines 20, 22, 24, as shown in this embodiment, may be driven from the same fluid flow in the motherbore tubular 4.

In an alternative, simpler embodiment, the one or more of the non-rotating pipes 6, 12, 14 may be omitted. The drill string 28 passes through the opening 10 in the motherbore tubular 2.

The invention claimed is:

1. A method for making lateral openings out of a wellbore in a ground formation where multiple laterally directed, rotatable drill strings are movable in an axial direction inside a motherbore tubular, and where a leading end portion of each of the rotatable drill strings is equipped with a drill bit that is driven by that rotatable drill string, the method comprising:

inserting each of the rotatable drill strings through a laterally directed non-rotating pipe that is moveable in the axial direction inside the motherbore tubular;

arranging multiple axially moveable fluid driven engines each corresponding to one of the rotatable drill strings at different positions along the motherbore tubular;

connecting a first of the rotatable drill strings to a first of the fluid driven engines;

connecting other rotatable drill strings to other fluid driven engines, respectively, the first of the fluid driven engines being located downstream of the other fluid driven engines, each of the other rotatable drill strings and respective other non-rotating pipes passing through an annulus surrounding the first of the fluid driven engines;

wherein each of the fluid driven engines has an upper end exposed across the motherbore tubular to rotate the respective rotatable drill string about a centerline thereof; and directing a fluid flow in the motherbore tubular across the exposed upper ends of the fluid driven engines and through lower ends of the fluid driven engines to create rotation of the drill bits via the respective rotatable drill strings.

2. The method according to claim 1, further comprising passing at least the non-rotating pipe or the rotatable drill string through a wall opening of the motherbore tubular at a position distant from an end portion of the motherbore tubular.

3. The method according to claim 1, further comprising directing a portion of the fluid flow in the motherbore tubular through the fluid driven engines.

4. The method according to claim 1, further comprising restricting fluid bypassing the fluid driven engines.

5. The method according to claim 1, further comprising letting at least the non-rotating pipes or the rotatable drill strings be subjected to a differential pressure between the motherbore tubular and annular pressure in the wellbore and thus hydraulically forced towards the ground formation.

6. The method according to claim 1, further comprising maintaining the fluid driven engines inside the motherbore tubular during making the lateral openings.

7. The method according to claim 1, wherein the fluid driven engines are connected to opposite end portions of the respective rotatable drill strings spaced from the leading end portions thereof.

8. A pipe device for making lateral openings out of a wellbore in a ground formation where multiple laterally directed rotatable drill strings are movable in an axial direction inside a motherbore tubular, the rotatable drill strings being inserted in respective non-rotating pipes that are moveable in the axial direction inside the motherbore tubular, where a leading end portion of each rotatable drill string is equipped with a drill bit that is driven by the respective rotatable drill string, wherein multiple fluid driven engines are arranged axially movable in the motherbore tubular, each engine having an upper end exposed across the motherbore tubular and being configured to be driven by a fluid flow in the motherbore tubular directed across the exposed upper end of and through a lower end of the respective fluid driven engine, the fluid driven engines being arranged at different positions along the motherbore tubular, wherein a first of the fluid drive engines is located downstream of other fluid driven engines, the first of the fluid driven engines being connected to a first of the rotatable drill strings and rotatable about a centerline thereof, and wherein other rotatable drill strings are connected to the other fluid driven engines, respectively, the other rotatable drill strings and respective other non-rotating pipes passing through an annulus surrounding at least the first of the fluid engines to reach the other fluid driven engines, respectively.

9. The pipe device according to claim 8, wherein at least one of the non-rotating pipes or the rotatable drill strings passes through a wall opening of the motherbore tubular at a position distant from an end portion of the motherbore tubular.

10. The pipe device according to claim 8, wherein at least one of the non-rotating pipes or the rotatable drill strings is subjected to a differential pressure between the motherbore tubular and annular pressure in the wellbore and thus hydraulically forced towards the ground formation.

11. The pipe device according to claim 8, wherein at least one of the non-rotating pipes or the rotatable drill strings is subjected to a differential pressure across the respective one of the fluid driven engines in the motherbore tubular and thus hydraulically forced towards the ground formation.

12. The pipe device according to claim 8, wherein the fluid driven engines are movable along a guide in the motherbore tubular.

13. The pipe device according to claim 8, wherein bypass openings constitute chokes.

14. The pipe device according to claim 8, wherein the non-rotating pipes are connected to housings of the respective fluid driven engines.

15. The pipe device according to claim 8, wherein the fluid driven engines are maintained inside the motherbore tubular during making the lateral openings, and are connected to opposite end portions of the rotatable drill strings spaced from the leading end portion thereof.

16. A method for making lateral openings out of a wellbore in a ground formation where first and second laterally directed, rotatable drill strings are movable in an axial direction inside a motherbore tubular, and where leading end portions of the first and second rotatable drill strings are equipped with and drive first and second drill bits, respectively, the method comprising:

inserting the first and second rotatable drill strings through first and second laterally directed non-rotating pipes, respectively, each of the first and second rotatable drill strings and the first and second laterally directed non-rotating pipes being moveable in the axial direction inside the motherbore tubular;

arranging first and second axially moveable fluid driven engines corresponding to the first and second rotatable drill strings at different positions along the motherboard tubular, wherein the first fluid driven engine is positioned upstream of the second fluid driven engine;

connecting the first and second rotatable drill strings to the first and second fluid driven engines, respectively, wherein the second rotatable drill string passes through an annulus surrounding the first fluid driven engine to reach the second driven engine;

wherein the first and second fluid driven engines have upper ends exposed across the motherbore tubular to rotate the first and second rotatable drill strings about centerlines thereof, respectively; and directing a fluid flow in the motherbore tubular across the exposed upper ends of and through lower ends of the first and second fluid driven engines to rotate the first and second drill bits.

17. The method according to claim 16, further comprising passing at least the first non-rotating pipe or the first rotatable drill string through a wall opening of the motherbore tubular at a position distant from an end portion of the motherbore tubular.

18. The method according to claim 16, further comprising directing a portion of the fluid flow in the motherbore tubular through the first fluid driven engine.

19. The method according to claim 16, further comprising restricting fluid bypassing the first fluid driven engine.

20. The method according to claim 16, further comprising letting at least the first non-rotating pipe or the first rotatable drill string be subjected to a differential pressure between the motherbore tubular and annular pressure in the wellbore and thus hydraulically forced towards the ground formation.

* * * * *